US011584618B2

(12) United States Patent
Hänninen et al.

(10) Patent No.: US 11,584,618 B2
(45) Date of Patent: Feb. 21, 2023

(54) DEVICE AND METHOD FOR THE EVACUATION OF BUILDINGS

(71) Applicant: KONE CORPORATION, Helsinki (FI)

(72) Inventors: Ari Hänninen, Helsinki (FI); Reetta Ranne, Helsinki (FI); Kirsi Nyrhinen, Helsinki (FI); Nithil Karimpanackal Natarajan, Helsinki (FI); Hannu Nousu, Helsinki (FI); Liina Poropudas, Helsinki (FI); Cristina Bianchi, Helsinki (FI); Jukka Turpeinen, Helsinki (FI); Jarmo Parkkinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 1143 days.

(21) Appl. No.: 16/143,047

(22) Filed: Sep. 26, 2018

(65) Prior Publication Data

US 2019/0023530 A1 Jan. 24, 2019

Related U.S. Application Data

(63) Continuation of application No. PCT/EP2016/060159, filed on May 6, 2016.

(51) Int. Cl.
*B66B 5/02* (2006.01)
*B66B 11/00* (2006.01)
(Continued)

(52) U.S. Cl.
CPC ..... *B66B 5/024* (2013.01); *B66B 1/28* (2013.01); *B66B 5/0031* (2013.01); *B66B 5/021* (2013.01); *B66B 11/0005* (2013.01); *B66B 9/003* (2013.01)

(58) Field of Classification Search
CPC ... B66B 5/0006; B66B 5/0018; B66B 5/0031; B66B 5/02–024; B66B 5/027;
(Continued)

(56) References Cited

U.S. PATENT DOCUMENTS 5,836,424 A * 11/1998 Allen ..... E06B 3/4636 49/120
2006/0191749 A1* 8/2006 Sasaki ..... B66B 13/301 187/391
(Continued)

FOREIGN PATENT DOCUMENTS

JP 57-27879 A 2/1982
JP 02075593 A * 3/1990
(Continued)

OTHER PUBLICATIONS

International Search Report, issued in PCT/EP2016/060159, dated Feb. 14, 2017.
(Continued)

*Primary Examiner* — Christopher Uhlir
(74) *Attorney, Agent, or Firm* — Birch, Stewart, Kolasch & Birch, LLP

(57) ABSTRACT

A method and a system for the evacuation of buildings providing an elevator system includes at least one elevator car and an elevator shaft. The system includes a device to detect an incident or a device to receive an emergency signal in this regard, a device for determining the floor of this incident, and at least one sealing element (positioned in the elevator shaft and constructed to seal the elevator shaft, so that the elevator shaft is divided in at least two sections.

18 Claims, 2 Drawing Sheets

Figure 1:
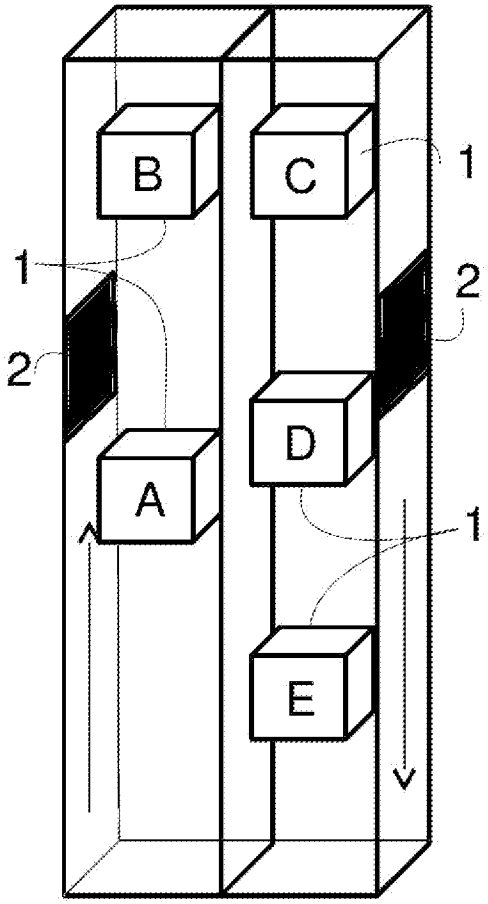

(51) Int. Cl.
*B66B 1/28* (2006.01)
*B66B 5/00* (2006.01)
*B66B 9/00* (2006.01)

(58) Field of Classification Search
CPC . B66B 11/0005; B66B 11/02; B66B 11/0206; B66B 11/0226; B66B 13/00; B66B 13/24–28; B66B 13/30
See application file for complete search history.

(56) References Cited

U.S. PATENT DOCUMENTS

2007/0170008 A1* 7/2007 Na ..... B66B 13/303
187/336
2012/0305337 A1* 12/2012 Hopp ..... B66B 13/306
187/336

FOREIGN PATENT DOCUMENTS

JP 9-315717 A 12/1997
JP 2012-30932 A 2/2012

OTHER PUBLICATIONS

Written Opinion ofthe International Searching Authority, issued in PCT/EP2016/060159, dated Feb. 14, 2017.

* cited by examiner

DEVICE AND METHOD FOR THE EVACUATION OF BUILDINGS

CROSS REFERENCE TO RELATED APPLICATIONS

This application is a Continuation of PCT International Application No. PCT/EP2016/060159, filed on May 6, 2016, the entirety of which is incorporated herein by reference into the present application.

FIELD OF THE INVENTION

The invention relates to a device and a method for the evacuation of buildings, especially in an emergency of fire or other cases of emergency when there is the need to evacuate a building.

BACKGROUND OF THE INVENTION

Regarding office buildings, apartment buildings or similar estates, where many people work or live in one construction of many floors, there is the danger of a fatal situation if the inhabitants are not able to leave the building in the case of emergency, e.g. a fire accident.

Especially in the case of a fire, a local source of fire could spread out fast and possibly trap inhabitants in inaccessible—and inescapable—areas of a building. In addition, toxic gases slowly spread out in the whole building poisoning inhabitants that will possibly faint and, thus, won't be able to escape.

The reduction of evacuation time is therefore very important to reduce or even eliminate fatalities and serious illnesses.

Therefore, it is a goal to get a tall building evacuated in a time of about 15 minutes. This is usually the period within which the spreading of a fire or its gases is not fatal.

The disadvantage of the present state of the art is that there is not a proper solution to evacuate a building by using elevators today. Traditional elevators are simply not allowed to be used during evacuation and only staircases are used for evacuation. This causes major problems in tall buildings, since more than 100 meters walk in a staircase is very challenging for many people and sometimes no alternative for persons with walking difficulties.

By using current methods, the evacuation could take 45 minutes or more.

In JP S57 27879, at a basket upon arrival at a fire floor, a plate is described to move forward to close a gap of a hoistway and landing, and an air blowing by a blower in the basket is started. As a result, a pressure in the basket is increased and fire smoke that enters from the hall to an elevator shaft and the basket is prevented. In JP H09 315717 A, when a fire occurs, smoke flows into a hoistway from a clearance of a landing door, and a smoke detector provided on an upper part of a landing entrance/exit is operated. When air is fed into an air bag by an air bag controller, the air bag closes the hoistway in an intermediate floor and the smoke is prevented by the air bag. In JP 2012 030932 A, a partition device is described which is provided in the middle of a hoistway, and a pair of partition members of the partition device rotate and spread out in a horizontal state in the event of fire so that the cross section in the hoistway is partitioned into an upper and lower part.

AIM OF THE INVENTION

The aim of the present invention is to disclose a solution, which eliminates or at least alleviates the one or more of the drawbacks occurring in prior-art solutions presented above, and to enable a fast and secure evacuation of a building using the elevator system of this building, at least as an alternative to the stairs.

It is also an aim of the invention to disclose an elevator system which is optimized in regard to the prior art.

SUMMARY OF THE INVENTION

The device and the method according to the invention and preferred embodiments are characterized by the claims. Some further inventive embodiments are also presented in the descriptive section and in the drawings of the present application. The features of the various embodiments of the invention can be applied within the scope of the invention in conjunction with other embodiments.

It should be noted that it is very dangerous to use an elevator in the case there is a fire or toxic fumes in the shaft. This will be considered by the following invention. The present invention enables the evacuation of a tall building even if there are toxic fumes or fire somewhere in the elevator shaft.

It should also be noted that the case of fire is only one emergency the invention can be used. In general, the invention is applicable for any incident, where the elevator shaft could be contaminated or filled with toxic gases, radioactive substances, causative organisms, heat, cold gases or else. In the following, the position of the emergency situation will be referred to with the expression "floor of incident".

The method to evacuate buildings by using an elevator system is based on the steps:

- Detecting an incident (e.g. a fire and/or the emission of toxic gases) or receiving an emergency signal in this regard, and determining the floor of this incident,
- optionally: moving at least one elevator car in a predefined evacuation position,
- sealing the elevator shaft with at least one sealing element, so that the elevator shaft is divided in at least two sections,
- moving at least one elevator car within at least one of these sections to evacuate the inhabitants of the floors below and/or above the floor of incident.

The invention refers to a system for the evacuation of buildings providing an elevator system comprising at least one elevator car and an elevator shaft, and is characterized in that it comprises means to detect an incident (e.g. a fire and/or the emission of toxic gases) or means to receive an emergency signal in this regard, means to determine the floor of this incident, and at least one sealing element positioned in the elevator shaft, which is constructed to seal the elevator shaft, so that the elevator shaft is divided in at least two sections by the sealing element.

The invention also refers to an elevator shaft that is provided with at least one sealing element positioned in the elevator shaft and constructed to seal the elevator shaft, so that the elevator shaft is divided in two sections by the sealing element.

Means for detecting an incident (e.g. a fire and/or the emission of toxic gases, organisms, radiation) are well known in the art, as well as means for receiving an emergency signal in the regard of fire or toxic gases or one of the other incidences.

In the following, there is only referred to fire, where the case of the emission of toxic or contaminating gases should be included, since the emission of toxic gases (without a fire)

may indeed occur (regarding e.g. laboratories or chemical factories), where the case of fire, however, will be the most common case.

Preferred means to detect an incident are sensors from the group fire sensors, smoke sensors, gas sensors, radiation sensors and sensors for detecting biohazard. In a preferred embodiment, the system of the invention is connected to the fire-alarm-system of the building. Since most buildings are equipped with a fire-alarm-system, this could be the alternative with the lowest costs.

In general, the sensor detecting an incident also defines the floor of incident. Usually even in the case of the use of a fire-alarm-system, the floor of incident is defined by the alarm-button pressed. Thus, determining of the floor of incident will be easy by determining the respective sensor or alarm-button.

In a preferred embodiment, the system also comprises the above mentioned sensors in the elevator shaft. With the help of these sensors it is possible to determine during evacuation, whether the atmosphere or heat in the respective shaft-section is safe for evacuation or not.

In addition regarding cable bound elevator systems, by using these sensors in the shaft, it is possible to determine, if the cables are still suitable for evacuation despite of the heat in other sections of the elevator shaft.

The sealing of the elevator shaft is necessary to prevent fire, particles or gases to enter the section of the elevator shaft where the evacuation is managed. It is not necessary to seal the shaft air-tight, since small amounts of particles or toxic gases could probably be ignored, however, an air-tight sealing of the shaft is preferred.

The sealing of the shaft is accomplished with at least one sealing element. This sealing element is preferably a sliding door, a trapdoor, a hatch, has the shape of an iris diaphragm or the shape of a roller shutter. It comprises at least one door element, although two or more door elements are also preferred (e.g. two or more door wings or elements of an iris diaphragm).

Although in the easiest case, the concept of the invention could be accomplished with only one sealing element (e.g. arranged at the half of the height of the elevator shaft) that splits the shaft in two sections, one upper section and one lower section. In one of these sections the floor of incident will be, so that this section cannot be evacuated using the elevator system, but the other section of the elevator shaft is separated from the floor of incident and there the elevator car(s) could be used to evacuate the inhabitants.

In a preferred embodiment at least one of the sealing elements is inflatable, especially by a gas-cartridge. Although the shape should correlate to the cross section of the elevator shaft, it is not necessary to match 100%, since due to the non-rigid walls of the inflatable sealing element and due to the inflating process, a sealing could easily be accomplished.

It should be noted that if there are toxic fumes or fire in the shaft in upper floors, the invention allows elevators still to evacuate people from lower floors.

In the case of e.g. a fire trap door as sealing element, which seals the shaft below the area where toxic fumes or fire exist, the gases will ascent due to the heat. Below the trap door there will be a temporary turning point of the elevator car(s) and that way elevators can continue normal evacuation of the floors below the fire.

To optimize the evacuation, it is preferred that there are sealing elements arranged at more than one floor, especially at all floors. The exact position of the sealing elements is between the elevator doors of adjoining floors so that the sealing of two adjoining sealing elements would result in the division of the elevator shaft in three sections (what is especially preferred), where one section lies under the floor of incident, one section lies above the floor of incident and one section includes the elevator door of the floor of incident and no (or only a negligible amount of) heat/toxic gases penetrating the door may intrude into the other sections that can be used for safe evacuation.

Thus although the division of the elevator shaft in two sections could be sufficient for the easiest embodiment of the invention, it is preferred that the elevator shaft is divided in at least three sections as described above.

Especially in cases where buildings are already provided with a multi-car elevator system, one elevator car could be used as sealing element in that it is arranged right in front of the elevator doors of the floor of incident and not moved during evacuation.

In this case it is preferred that at least one elevator car, especially all elevator cars, and/or at least one of the landings, especially all landings, are provided with car-sealing elements that are designed to seal the gap between a respective elevator car and a respective landing. This seal should especially be airtight to prevent gases to enter the shaft.

To provide a smooth operation in the case there is no emergency (normal operation), the car-sealing elements should be designed to be moved in a sealing position in the case of an emergency and stay in a non-sealing position during normal operation. This is preferably achieved with moving elements, especially motor-driven, hydraulic and/or pneumatic moving elements. The car-sealing elements could also preferably fall into position by gravity if a lock bar, holding the car-sealing elements in a non-sealing position, is opened in the case of an emergency.

It is also preferred that the car-sealing elements are inflatable, especially by a gas-cartridge (e.g. $CO_2$). For example could a inflatable bulge be fixed around the doors of a an elevator car (or of a landing site) and inflated in the case of an emergency. This would render a tight seal around the only apertures (doors) of a landing and the gap between elevator car and shaft-wall of the landing. These inflatable seals could be a very easy and low priced alternative.

It is possible to recondition existing elevator systems (cars and/or landing sites) with these car-sealing elements.

In a preferred embodiment, the alternative using an elevator car is combined with additional sealing elements (e.g. fire doors). This would render a redundant sealing of a landing.

In a preferred embodiment, the sealing elements comprise apertures at a position where the cables of the elevator system will be in the sealed position of the sealing elements. These apertures should be small, especially less than 5 cm (or better less than 2 cm) larger than the diameter of the elevator cables. This has the advantage that the elevator cable can move the car even in the case the car is in the section below the sealing element (to evacuate the inhabitants to the street) and no great amounts of gases can stream through the small apertures.

There are well known requirements for the design of fire protection doors in nearly every state on the world. Preferably each sealing element is designed as fire protection door.

In a preferred embodiment, the sealing elements are made from a rigid material, especially metal or plastic (especially heat-resistant plastic as e.g. PEEK). Metal is preferred, especially in a thickness more than 1 mm (or even more than 4 mm). That has the advantage that small objects falling from above may not perforate or destroy the sealing elements. In general, the sealing elements have the additional advantage to eliminate or at least decrease the chimney effect of the elevator shaft.

It is preferred that the sealing elements or the elevator system comprise sensors to prohibit the sealing of the shaft if an elevator car is in the way of the respective sealing element. In the case one elevator car is broken in the way of a sealing element that should close, the system is preferably designed that the next suitable sealing element seals the shaft instead.

The elevator system comprises at least one elevator car. However, the benefit of the invention is recognized best, if the elevator system comprises two or more elevator cars that can be moved independently. These multicar systems allow higher transportation capacity, as well as a distributed operation of elevator activities (e.g. above and below the floor of incident).

Known elevator systems are operated by the use of steel cables or elevator cars having an individual moving system (slip-resistant moving means driven by an electric motor).

Although the invention could be executed with traditional one-car systems, where the car operates in one of the sections separated by the sealing elements, there are much more advantages of the invention concerning multicar concepts, since the cars could operate in all separated areas and carry much more inhabitants in the same time compared to a one-car system.

Although the invention could be realized with cable-bound elevator systems, where the sealing element(s) comprise(s) (small) apertures for the cables (see description above), there are much more advantages of the invention concerning elevators where the cars are driven by individual moving systems, since the sealing elements do not need apertures and could be designed to hermetically seal the shaft.

If there are not enough elevator cars in one area of the elevator shaft or the only elevator car is in the wrong position, it is preferred to move at least one elevator car in a predefine position before sealing the shaft. This movement should override all calls of present or future passengers.

In a special embodiment, before the closing of a sealing element, all cars above the floor of incident are moved to floors below the floor of incident.

In another special embodiment, before the closing of a sealing element, the ratio of inhabitants above:below the floor of incident is determined and the elevator cars are arranged so that the number of cars above and below the floor of incident correspond to this ratio. If more inhabitants are above a fire, than more cars would be in the section above the fire to carry the inhabitants to the roof or other escape routes (e.g. bridges). The ratio of inhabitants above/below the floor of incident does not need to be determined by counting, but could also be determined by the statistical occupancy of the floors at the time of incident.

In a preferred embodiment, the system is designed to separate safety elements of the elevator systems from the main safety system of the elevator system. Usually, the safety system prevents certain moving procedures in the case of certain occurrences. In the case of evacuation, it does not matter, if special safety requirements in the area of incident are achieved. So these safety elements are excluded from the safety system. It should be noted that it could be advantageous to control the state of the cables in a cable bound system even in the area of incident.

It is also preferred to separate the elements of the safety system of the elevator system into two sub-systems controlling the separated sections of the elevator shaft. This has the advantage that the evacuation of the section above the floor of incident is not affected by occurrences during the evacuation in the section below the floor of incident and the other way round.

Especially in multicar elevator systems, when most of the control is in the car and especially when the shaft part signal control is at the bottom of the shaft, it is preferred to cut the safety circuit and other shaft signals from the upper part of the shaft.

When the sealing elements seal the shaft, it is preferred to cut the safety chain and other electric control signals at the same time, so that floors above the safety elements are not connected to the safety system of the floors below the floor of incident (however, there may be overlaps, e.g. the control of the cables).

In a preferred embodiment, turning or rotation points for the elevator cars are adjusted to the sections of the sealed elevator shaft.

LIST OF FIGURES

In the following, the invention will be described in detail by the aid of examples of its embodiments, wherein:

FIG. 1 outlines a preferred system.

Figure 2:
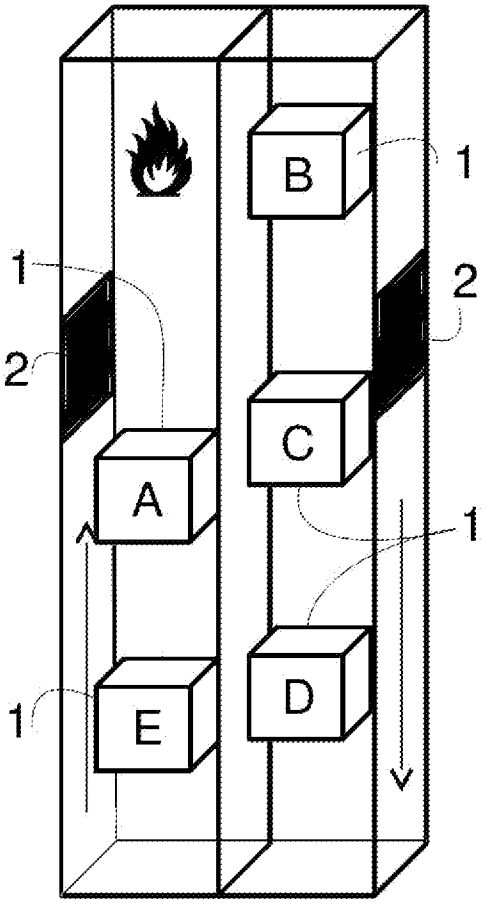

FIG. 2 outlines the movement of elevator cars in the case of a fire.

Figure 3:
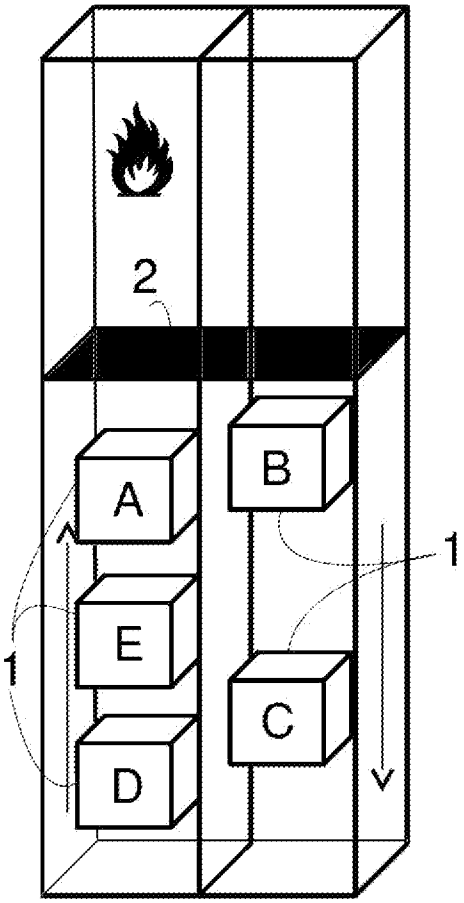

FIG. 3 outlines the sealing of the elevator shaft.

Figure 4:
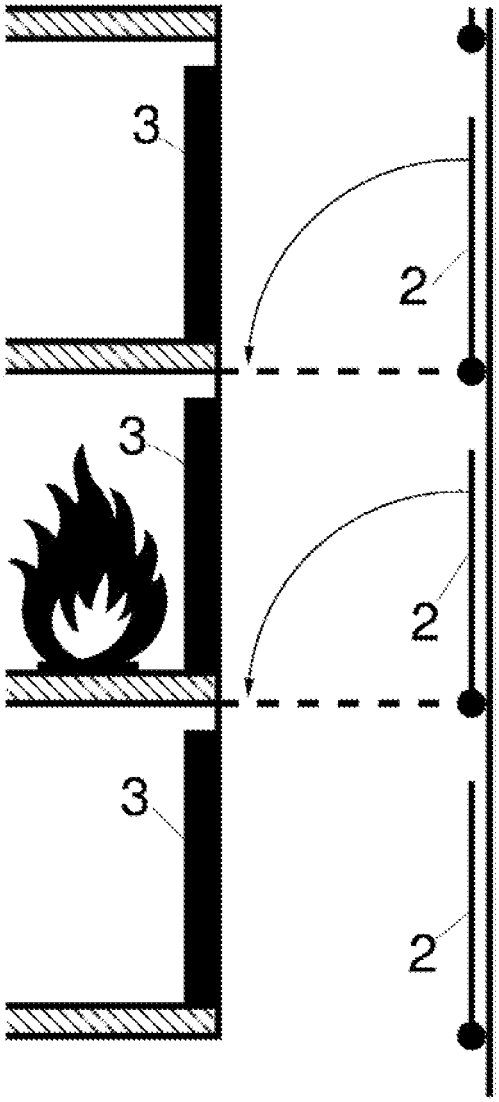

FIG. 4 demonstrates another preferred embodiment.

DETAILED DESCRIPTION OF THE INVENTION

FIGS. 1 to 3 outline a preferred system and display the method of the invention. Here the elevator system comprises several elevator cars 1 (multi-car-system A to E) that move in two elevator shafts or one double elevator shaft, respectively. In the figure it is assumed that the elevator cars 1 (A, E, D) move upward in the left shaft and downward in the right shaft (B, C, see arrows). When the Elevator cars 1 reach the top or the bottom, they move sideways to reach the other elevator shaft so that a closed cycle occurs.

In the middle of the shaft there are two fire trap doors 2 positioned that act as sealing elements.

In FIG. 2 a fire breaks out in one of the upper floors. Immediately the lower elevator cars 1 stop below the fire trap doors 2 (here cars A and E) and the elevator cars 1 that are above the fire trap doors 2 (here cars B to D) continue their movement until they are positioned under the fire trap doors 2.

In the case there would be an upper shaft segment that is separated from the fire, the elevator cars could be arranged both above and below the floor of incident. However, FIG. 2 only shows a simple example.

In FIG. 3 the fire trap doors 2 are closed and the elevator cars 1 begin their movement in the shaft segment below the fire trap doors 2 to evacuate all inhabitants in the lower floors. This will enhance the evacuation speed.

The preferred method is outlined in the following:

When the fire is detected above the fire trap doors 2 then:

Elevator cars 1 going up-direction are informed not to travel close to fire trap doors 2.

New guiding information is given to passengers which remain in the floors above the fire trap doors 2.

Elevator cars 1 that are above or close to the fire trap doors 2 are informed to travel below the fire trap doors 2 as quickly as possible.

Elevator cars on up-direction shaft may, if possible also travel downwards in order to get all floors above the fire trap doors 2 clear.

When the floors are clear, then the fire trap doors 2 can start to close.

Releasing of the lock of the fire trap doors 2 starts the closing. Lock release is e.g. accomplished by an electric signal.

The closing of the fire trap doors 2 may occur by motors, hydraulic cylinders or other means to close it properly. In an easy embodiment they can just fall shut due to gravity.

When the fire trap doors 2 are closing, the system preferably cuts the safety circuit and other signals above the fire trap doors 2 and shortcuts safety circuit signals so that the safety circuit below fire trap doors 2 operates normally.

In FIG. 4 an embodiment is outlined where there are several fire trap doors 2 that are arranged such that they seal the elevator shaft at positions between the floors (see broken lines). In the case of a fire behind an elevator door 3, the fire trap doors 2 above and below that elevator door 3 will seal the elevator shaft as shown by the arrows and the broken lines outlining the position of the fire trap doors 2 in closed state.

With this embodiment, the floor of incident will be completely separated from the rest of the elevator shaft and evacuation by elevator cars (not shown) may be accomplished in the section below the floor of incident as well as in the section above the floor of incident.

It should be noted that if the fire spreads in adjacent floors or breaks out in more floors, the sealing may be accomplished not by adjacent fire trap doors 2, but with the sealing of all relevant fire trap doors 2.

The invention claimed is:

1. An elevator shaft provided with comprising:

at least one sealing element positioned in the elevator shaft and constructed to seal the elevator shaft, so that the elevator shaft is divided into at least two sections by the at least one sealing element, wherein at least one landing of the elevator shaft is provided with car-sealing elements that are designed to seal a gap between a respective elevator car and the respective landing.

2. A system for the evacuation of buildings providing an elevator system comprising at least one elevator car and an elevator shaft, said system comprising:

means to detect an incident or means to receive an emergency signal;

means for determining a floor of the incident or the emergency signal; and at least one sealing element positioned in the elevator shaft and constructed to seal the elevator shaft, so that the elevator shaft is divided into at least two sections by the at least one sealing element, wherein the elevator system comprises two or more elevator cars that can be moved independently, and wherein at least one elevator car or at least one landing is provided with car-sealing elements that are designed to seal a gap between the respective elevator car and the respective landing.

3. The elevator shaft as claimed in claim 1, wherein the at least one sealing element is a sliding door, a trapdoor, a hatch, has the shape of an iris diaphragm or the shape of a roller shutter or is inflatable, and wherein the at least one sealing element comprises at least one door element.

4. The elevator shaft as claimed in claim 1, wherein the at least one sealing element is arranged at more than one floor, wherein a position of the at least one sealing element is between elevator doors of adjoining floors so that sealing of two adjoining sealing elements would result in the division of the elevator shaft into three sections, where one section lies under an area or a floor of an incident, one section lies above the area or the floor of the incident and one section includes an elevator door of the floor of the incident or elevator doors of the area of the incident.

5. The system as claimed in claim 2, wherein the elevator system is operated by the use of steel cables or elevator cars having an individual moving system.

6. The system as claimed in claim 2, wherein the car-sealing elements are designed to be moved in a sealing position in the case of an emergency and stay in a non-sealing position during normal operation, and wherein the system comprises moving elements that are designed to move the car-sealing elements in a sealing position in the case of emergency, move lock bars holding car-sealing elements in a non-sealing position or wherein the system comprises the car-sealing elements that are inflatable and the system comprises elements to inflate the car sealing elements in an emergency case.

7. The system as claimed in claim 2, wherein the system is designed to separate safety elements of the elevator system from a main safety system of the elevator system, and wherein the system is designed to separate the of the elevator system into two sub-systems controlling the divided sections of the elevator shaft.

8. The elevator shaft as claimed in claim 1, further comprising at least one of fire sensors, smoke sensors, gas sensors, radiation sensors and sensors for detecting biohazard in the elevator shaft, and is designed to determine during evacuation, whether the atmosphere or heat in the respective shaft-section is safe for evacuation or not.

9. The elevator shaft or system as claimed in claim 8, wherein the sensors are in the elevator shaft.

10. The system as claimed in claim 2, further comprising at least one of fire sensors, smoke sensors, gas sensors, radiation sensors and sensors for detecting biohazard in the elevator shaft, and is designed to determine during evacuation, whether the atmosphere or heat in the respective shaft-section is safe for evacuation or not, wherein the sensors are in the elevator shaft, and wherein the elevator system is a cable bound elevator system, the sensors determine, determine if cables of the elevator system are still suitable for evacuation despite of heat in other sections of the elevator shaft.

11. The system as claimed in claim 2, wherein the at least one sealing element comprise apertures at a position where cables of the elevator system will be in a sealed position of the at least one sealing element, and wherein these apertures are less than 5 cm larger than a diameter of the cables.

12. A method to evacuate buildings by using an elevator system comprising the steps of:

detecting an incident or receiving an emergency signal, and determining a floor of the incident or emergency signal;

moving at least one elevator car of a plurality of elevator cars in a predefined evacuation position;

sealing an elevator shaft with at least one sealing element, so that the elevator shaft is divided into at least two sections by the at least one sealing element;

providing at least one landing of the elevator shaft with car-sealing elements that are designed to seal a gap between a respective elevator car and the respective landing; and moving the at least one elevator car in at least one of these sections to evacuate inhabitants of floors below and/or above the floor of the incident or the emergency signal.

13. The method as claimed in claim 12, wherein, before closing of the at least one sealing element, any of the plurality of elevator cars above the floor of the incident or the emergency signal are moved to floors below the floor of the incident or the emergency signal or before the closing of the at least one sealing element, a ratio of inhabitants above:below the floor of the incident or the emergency signal is determined and the elevator cars are arranged so that a number of cars above and below the floor of the incident or the emergency signal correspond to the ratio.

14. The system as claimed in claim 2, wherein at least one sealing element is a sliding door, a trapdoor, a hatch, has the shape of an iris diaphragm or the shape of a roller shutter or is inflatable, and wherein the at least one sealing element comprises at least one door element.

15. The system as claimed in claim 2, wherein the at least one sealing element is arranged at more than one floor, and wherein a position of the at least one sealing element is between elevator doors of adjoining floors so that sealing of two adjoining sealing elements would result in the division of the elevator shaft in three sections, where one section lies under an area or floor of the incident or the emergency signal, one section lies above the area or floor of the incident or the emergency signal and one section includes an elevator door of the floor of the incident or the emergency signal or elevator doors of the area of the incident or the emergency signal.

16. The elevator shaft as claimed in claim 3, further comprising at least one of fire sensors, smoke sensors, gas sensors, radiation sensors and sensors for detecting biohazard in the elevator shaft, and is designed to determine during evacuation, whether the atmosphere or heat in the respective shaft-section is safe for evacuation or not.

17. The elevator shaft as claimed in claim 4, further comprising at least one of fire sensors, smoke sensors, gas sensors, radiation sensors and sensors for detecting biohazard in the elevator shaft, and is designed to determine during evacuation, whether the atmosphere or heat in the respective shaft-section is safe for evacuation or not.

18. The system as claimed in claim 2, further comprising at least one of fire sensors, smoke sensors, gas sensors, radiation sensors and sensors for detecting biohazard in the elevator shaft, and is designed to determine during evacuation, whether the atmosphere or heat in the respective shaft-section is safe for evacuation or not.

* * * * *